United States Patent [19]

Joshi et al.

[11] Patent Number: 5,043,091

[45] Date of Patent: Aug. 27, 1991

[54] PROCESS FOR MANUFACTURING ALKYL POLYSACCHARIDE DETERGENT LAUNDRY BAR

[75] Inventors: David P. Joshi, S. Plainfield; Heidrun Maaser, Monmouth Junction, both of N.J.

[73] Assignee: Colgate-Palmolive Co., Piscataway, N.J.

[21] Appl. No.: 369,538

[22] Filed: Jun. 21, 1989

[51] Int. Cl.[5] ..... C11D 11/00; C11D 1/83; C11D 3/22; C11D 17/02

[52] U.S. Cl. ..... 252/174.17; 252/174; 252/550; 252/553; 252/559; 252/DIG. 16

[58] Field of Search ..... 252/174.17, DIG. 16, 252/DIG. 5, 174, 550, 553, 559, 367-370

[56] References Cited

U.S. PATENT DOCUMENTS

| | | | |
|---|---|---|---|
| 4,396,520 | 8/1983 | Payne et al. | 252/89.1 |
| 4,483,780 | 11/1984 | Llenado | 252/135 |
| 4,536,317 | 8/1985 | Llenado et al. | 252/174.17 |
| 4,536,318 | 8/1985 | Cook et al. | 252/174.17 |
| 4,536,319 | 8/1985 | Payne | 252/174.17 |
| 4,543,204 | 9/1985 | Gervasio | 252/531 |
| 4,565,647 | 1/1986 | Llenado | 252/354 |
| 4,599,188 | 7/1986 | Llenado | 252/174.17 |
| 4,675,127 | 6/1987 | Rickle et al. | 252/174.17 |
| 4,707,289 | 11/1987 | Ramachandran et al. | 252/135 |
| 4,721,581 | 1/1988 | Ramachandran et al. | 252/135 |
| 4,767,560 | 8/1988 | Gervasio | 252/108 |
| 4,806,273 | 2/1989 | Barone et al. | 252/544 |

*Primary Examiner*—Paul Lieberman
*Assistant Examiner*—A. Beadles-Hay
*Attorney, Agent, or Firm*—Colgate-Palmolive Co.

[57] ABSTRACT

Detergent laundry bars of improved foaming, better skin feel/mildness and fabric softening properties are provided. These laundry bars are based on alkyl polysaccharide nonionic surfactants with alkyl benzene sulfonate anionic surfactant, detergent builder and filler. Processing into laundry bars which additionally contains high melting higher fatty alcohol sulfate anionic cosurfactant is greatly facilitated by pre-blending the alkyl polysaccharide nonionic surfactant and higher fatty alcohol sulfate cosurfactant prior to feeding the mixture to the mixer and plodder.

1 Claim, No Drawings

PROCESS FOR MANUFACTURING ALKYL POLYSACCHARIDE DETERGENT LAUNDRY BAR

BACKGROUND OF THE INVENTION

This invention relates to detergent laundry bars. More particularly, it relates to built detergent laundry bars based on alkyl polysaccharide nonionic detergent surfactant. Such bars, which also contain alkylbenzene sulfonate anionic builder, bodying agent and water, and optionally, higher fatty alcohol sulfate anionic co-surfactant are superior in various important characteristics to bars of the same formula without the alkyl polysaccharide. Important properties in which the invented bars are superior include: hand wash foaming properties (initial foaming, persistence of foaming, and regeneration of foam when the wash water is re-used); resistance to sloughing and erosion; and processability.

Soap bars have for long been employed for washing the human body and for "doing laundry". Before the advent of washing machines dictated the employment of detersive material in powder, disintegrable briquette, or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabrics being laundered, as on a washboard, to deposit a high concentration of the soap on the soiled area, and they provided mechanical means for applying energy to such surfaces to assist in removing the stains and soils.

Despite the fact that after the introduction of synthetic organic detergents and washing machines the amount of soap employed for laundry use diminished greatly, soap in bar or cake form is still the personal cleaning agent of choice in most of the world, and laundry soaps and detergents in bar form are also still preferred by many consumers in some regions. Detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

Although branched chain higher alkylbenzene sulfonate detergents, such as sodium dodecylbenzene sulfonate (the dodecyl is often highly branched propylene tetramer but can be linear too), make satisfactory detergent laundry bars, such detergents have sometimes been found to be environmentally, ecologically, or economically unacceptable, and accordingly, efforts have been made to formulate detergent laundry bars based, in part, on other synthetic organic detergents which would be less objectionable or would be unobjectionable in such respects. Among leading candidates for use as such a detergent are the higher fatty alcohol (or alkyl) sulfates, especially the sodium salts, which are biodegradable and have been successfully employed in various detergent compositions. However, such higher fatty alkyl sulfates have been found to be susceptible to breaking and to becoming damaged during handling after storage and before final use. It was observed that they appeared to change physical properties after manufacture and became prone to excessive breakage during ordinary shipping and handling. Additionally, such products were often not as satisfactorily foaming as analogous laundry bars based on alkylbenzene sulfonate detergents. One solution to this problem is disclosed in U.S. Pat. No. 4,543,204 which teaches the incorporation of higher fatty acids in the bar formula to counteract the tendency of higher fatty alcohol sulfate laundry bars to crack or break during storage and shipment. The patent also mentions that the fatty acid improves foaming characteristics of the fatty alcohol sulfate bars.

However, this solution requires addition of a material to the formula which is not a detergent or a builder, and which may be comparatively expensive. The patent also includes a working example in which some of the alcohol sulfate is replaced by alcohol ethoxylated sulfate.

U.S. Pat. No. 4,515,707 discloses neutralization of ethoxylated fatty alcohol sulfuric acid with dry sodium carbonate powder in the presence of powdered sodium tripolyphosphate. The product resulting, sodium fatty alcohol ethoxylate, with sodium tripolyphosphate and sodium bicarbonate, is a free-flowing powder and is useful as a component of detergent laundry bars. Such bars may also contain other components in dry, powdered form, such as calcium carbonate and talc.

U.S. Pat. No. 4,472,287 discloses that a particulate fabric softening detergent composition may comprise a mixture of spray dried detergent composition beads (which can include ethoxylate sulfate detergent) and an agglomerate of bentonite and insoluble soap, and at column 14, lines 31–34, the compacting of such mixtures to briquettes is suggested.

U.S. Pat. No. 4,806,273 discloses a laundry detergent bar based on higher fatty alcohol sulfate detergent which includes 10 to 35% of higher fatty alcohol sulfate detergent, 10 to 60% of builder for the detergent mixture, a bodying proportion, in the range of 10 to 60% of water insoluble powder, 1 to 10% of higher fatty lower alkanolamide, 0.2 to 5% of qlycerol, with the ratio of alkanolamide to glycerol being in the range of 1:5 to 25:1 and 5 to 20% of water, which water includes water removable from any hydrate components of the detergent laundry bar when such bar is subjected to heating at 105° C. for two hours. Preferably the detergent laundry bars are milled and plodded and comprise 10 to 25% of sodium coco alcohol sulfate or equivalent sodium higher fatty alcohol sulfate, up to 5 or 10% of secondary detergents, 15 to 30% of sodium tripolyphosphate, 5 to 25% of sodium carbonate, 0 to 10% of sodium silicate, 10 to 50% of calcium carbonate powder, 3 to 7% of cocomonoethanolamide:glycerol being in the range with the ratio of cocomonoethanolamide:-glycerol being in the range of 2:1 to 25:1, and 5 to 12% of water.

U.S Pat. No. 4,721,581 discloses a built synthetic organic detergent laundry bar which comprises 15 to 40% of higher fatty alcohol ethoxylate sulfate, 10 to 50% of builder(s) for the sodium higher fatty alcohol ethoxylate sulfate, 5 to 40% of bentonite, and 5 to 20% of water, which water includes water removable from any hydrate components of such detergent laundry bar when said bar is subjected to heating at 105° C. for two hours. Preferably the detergent laundry bar comprises 20 to 35% of sodium higher fatty alcohol ethoxylate sulfate in which the higher fatty alcohol is of 10 to 18 carbon atoms and the ethoxylate moiety is of 2 to 10 ethoxyl groups, 5 to 35% of sodium tripolyphosphate, 0 to 25% of sodium carbonate, 0 to 10% of sodium silicate, 10 to 25% of bentonite and 8 to 15% of water.

Other patent art and publications which refer to detergent-laundry bars and to bar products containing various detergents, include British Patent Nos. 836,939, 941,988, 1,155,726, 1,191,721 and 1,191,722; *Detergent Age,* September 1965, pages 20, 21; and *Schimmel Briefs,* No. 364 (July 1965).

U.S. Pat. No. 4,396,520 discloses a detergent composition comprising an alkyl polysaccharide detergent surfactant, a calcium sensitive anionic detergent co-surfactant which may be an alkylbenzene sulfonate salt wherein the cation is selected from alkali metals, ammonium, mono-, di- or triethanolamine, calcium or magnesium or mixtures thereof, as well as other surfactant compounds, and up to 95% of a detergent builder with the ratio of the anionic co-surfactant to the alkyl polysaccharide being from 1:1 to about 6:1. The compositions disclosed in this patent are laundry detergent compositions formulated as spray-dried detergent granules.

U.S. Pat. No. 4,536,317 is directed to an agglomerated light-duty detergent granule composition. The ingredients of this composition include (1) from about 5% to about 60% of the alkyl polysaccharide surfactant; (2) from about 5% to about 60% of an alkylbenzene sulfonate co-surfactant in which the alkyl group contains from about 10 to about 13 carbon atoms; (3) from about 5% to about 60% of an alkyl polyethoxylate sulfate co-surfactant in which the alkyl group contains about 10 to 16 carbon atoms and from about 1 to about 6 ethoxylate groups; (4) from about 5% to about 80% of water soluble inorganic salts selected from sulfates, chlorides, carbonates, phosphates and mixtures thereof. There is a reference to soap bars (column 8, lines 7) although no laundry bars are disclosed, nor are any built compositions.

U.S. Pat. No. 4,565,647 is directed to a foaming composition comprising (1) alkyl polysaccharide surfactant and (2) anionic co-surfactant selected from sulfates, sulfonates, carboxylate and mixtures thereof. The ratio (2) to (1) is from about 1:10 to about 10:1, except that when the co-surfactant is an alkylbenzene sulfonate, the ratio of (2) to (1) is at least about 1:2. The alkyl polysaccharide has a free fatty alcohol content of about less than 2% by weight. Laundry bars or heavy duty laundry detergent compositions are not disclosed.

U.S. Pat. No. 4,483,780 is directed to compositions containing alkyl polyglycoside detergent surfactant and a nonionic detergent surfactant. Laundry bars are not disclosed, however, there is a broad disclosure that the composition may be used in a variety of forms, such as solids, powders, qranules, pastes, and liquids (column 12, lines 46–48). The compositions can include detergency builders including zeolite A, phosphates, carbonates and the like.

As described above, it has been proposed, and, in fact, commercially acceptable laundry bar products have been made available, which include higher fatty alcohol sulfates and/or higher fatty alcohol ethoxylate sulfates. However, these anionic surfactants are generally characterized by their high melting point. Therefore, when it is attempted to incorporate the molten surfactant directly into the bar manufacturing equipment, such as the detergent soap plodder, formation of bars becomes difficult and any temperature sensitive ingredients incorporated into the bar may be adversely effected.

The present invention provides a solution to this processing problem for laundry detergent bars which contain such normally solid higher fatty alcohol sulfates or ethoxylates thereof, while at the same time, with or without the higher fatty alcohol sulfate or higher fatty alcohol ethoxylated sulfate; provides a detergent laundry bar of acceptable laundry properties, including foaming characteristics (both initially and as a function of time), detergency, and mildness.

In accordance with the composition aspect of the invention, there is provided a detergent laundry bar containing at least one anionic surfactant, an alkyl polysaccharide nonionic surfactant, and one or more detergent builders, fillers and bodying agents, and a minor amount of water. More particularly, this invention provides a detergent laundry bar containing from about 10 to 45% of at least one anionic surfactant, from about 2 to 25% of alkyl polysaccharide nonionic surfactant, from about 10 to 60% of detergent builder, a bodying proportion, in amount of from about 10 to 65% of water insoluble powder, and up to about 20% of water and other minor ingredients. In an especially preferred embodiment, the anionic surfactant includes an alkylbenzene sulfonate or mixture thereof with higher fatty alcohol sulfate, and the alkyl polysaccharide is an alkyl polyglucoside, especially wherein the alkyl moiety is of approximately the same carbon chain length as the alkyl moiety of the higher fatty alcohol sulfate, when present.

In accordance with the processing aspect of the invention, there is provided an improved method for manufacturing a laundry detergent bar containing a normally solid higher fatty alcohol sulfate and/or higher fatty alcohol sulfate anionic surfactant, preferably in admixture with alkylbenzene sulfonate anionic surfactant, including the steps of mixing said anionic surfactant in molten form, with the remaining laundry detergent bar ingredients, including any other anionic surfactants, detergent builders, fillers, bodying agents and water; milling the resulting mixtures; plodding the milled product; and shaping the plodded product into the desired laundry detergent bar configuration; wherein the improvement is accomplished by premixing the molten higher fatty alcohol sulfate with alkyl polysaccharide nonionic surfactant to lower the temperature of the molten anionic surfactant, while still allowing the mixture to be transported in a flowable liquid state, and transferring the mixture to the mixing step.

Incorporation of the alkyl polysaccharide, especially alkyl polyglucoside, nonionic surfactant in place of some or all of the higher fatty alcohol sulfate and/or higher fatty alcohol ethoxylated sulfate in a laundry detergent bar provides improved foaming, better skin/-mildness and fabric softening properties. In addition, the polysaccharide surfactant can significantly facilitate incorporation of the molten alcohol sulfate anionic surfactant into the laundry bar by reducing the temperature of the melt without causing the surfactant to become too thick, viscous or tacky to be pumped using conventional detergent bar making equipment.

Glycoside surfactants suitable for use in the practice of the present invention include those of formula:

$$RO—(R^1O)_y(Z)_x \quad (A)$$

wherein R is a monovalent organic radical (e.g. a monovalent saturated aliphatic, unsaturated aliphatic or aromatic radical such as alkyl, hydroxyl alkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to about 18 more preferably from about 12 to about 16) carbon atoms; O is an oxygen atom; $R^1$ is a divalent hydrocarbon radical containing from 2 to 4 carbon atoms, such as ethylene, propylene or butylene (most preferably the unit $(R^1O)y$ represents repeating units of ethylene oxide, propylene oxide and/or random or block combination thereof); y is a number having an average value of from O to about 12; Z represents a moiety derived from a reducing saccharide containing 5 or 6 carbon atoms (most preferably a glucose unit); and x is a number having an average value of from 1 to about 10 (preferably from 1 to about 5, more preferably from 1 to about 3, and most preferably from about 1.2 to about 2).

Glycoside surfactants of the sort mentioned above, and various preferred subgenera thereof, are fully discussed in U.S. Pat. Nos. 4,483,779 to Llenado, et al. (issued Nov. 20, 1984) and 4,668,422 to Malik, et al. (issued Mar. 26, 1987) the discussions and descriptions of which are hereby incorporated by reference.

Glycoside surfactants suitable for use herein also include those of the Formula A above in which one or more of the normally free (i.e. unreacted) hydroxyl groups of the saccharide moiety, Z, have been alkoxylated (preferably, ethoxylated or propoxylated) so as to attach one or more pendant alkoxy or poly (alkoxy) groups in place thereof. In such event, the amount of alkylene oxide (e.g. ethylene oxide, propylene oxide, etc.) employed will typically range from about 1 to about 20 (preferably from about 3 to about 10) moles thereof per mole of saccharide moiety within the Formula A glycoside material.

In glycosides of the Formula A above, the $RO(R^1O)y$ group is generally bonded or attached to a number 1 carbon atom of the saccharide moiety, Z. Accordingly, the free hydroxyls available for alkoxylation are typically those in the number 2, 3, 4 and 6 positions in 6-carbon atom saccharides and those in the number 2, 3 and 4 positions in 5-carbon atom saccharide species. Typically, the number 2 position hydroxyls in 5-carbon saccharides, and the number 2 and 6 position hydroxyls in 6-carbon saccharides, are substantially more reactive or susceptible to alkoxylation than those in the number 3 and 4 positions. Accordingly, alkoxylation will usually occur in the former locations in reference to the latter.

Glycoside surfactants especially preferred for use herein include those of the Formula A above wherein R is an alkyl group containing from about 12 to about 14 or 16 carbon atoms; y is zero; Z is derived from glucose; and x has an average value of from 1 to about 3, especially from 1 or 1.2 to about 2.

The amount of unreacted alcohol (free fatty alcohol content) will generally be less than about 2%, e.g. 2.0%, 1.5%, 1.0%, 0.5%, by weight, based on the total glycoside and unreacted alcohol.

The indicated glycoside surfactants are typically employed in the compositions hereof in an amount ranging from about 1 to about 20 weight percent of total composition on a weight basis and preferably constitute a minor amount of total surfactant ingredient within said compositions (i.e. representing at most about 50 weight percent, preferably up to about 45% of the total surfactant content thereof). Preferably said glycoside surfactants constitute from about 2 to about 15 (most preferably from about 3 to about 10) weight percent of said compositions on a total composition weight basis.

The major detersive action of the invention laundry bar products is provided by anionic surfactant, preferably alkylbenzene sulfonate anionic surfactant, alone or in admixture with one or more additional anionic cosurfactants, as described below.

The preferred anionic surfactant is an alkali metal salt of a linear or branched $C_{10}$–$C_{18}$ alkylbenzene sulfonic acid, more preferably a linear $C_{10}$–$C_{15}$ alkyl, especially $C_{10}$–$C_{12}$ alkyl, such as linear dodecyl benzene sulfonate. The alkali metal may be sodium or potassium, preferably sodium. However, other cations, such as ammonium or amine, e.g. triethanolamine, or alkaline earth metals, especially magnesium or calcium, may also be used in conjunction with or in place of the alkali metal salts. For example, the magnesium salt can be incorporated for its effectiveness for greasy soil removal and/or its foam generating ability.

Another preferred anionic surfactant is a higher fatty alcohol sulfate. The higher fatty alcohol sulfate is one in which the higher alcohol or alkyl group is normally in the range of 10 to 18 carbon atoms. The cation will almost invariably be sodium or will include sodium although other cations, such as triethanolamine (most preferred, after sodium), potassium, ammonium, magnesium and calcium, may also be present, usually in minor proportion, with the sodium detergent normally constituting more than 50%, preferably more than 75% and most preferably all or substantially all of the higher fatty alcohol sulfate content of the laundry bar.

Other synthetic organic anionic detergents of the sulfated and/or sulfonated types (and in some cases nonionic and/or amphoteric detergents) may also be present in the laundry bar as secondary detergents but the total amounts of such secondary detergents will normally be only minor, with respect to the higher fatty alcohol sulfates. Among the secondary detergents those which are preferred, especially when biodegradability is desirable, include higher fatty alcohol ethoxylate sulfates, of 10 to 18 carbon atoms in the fatty alcohol moiety, and higher fatty acid monoglyceride sulfates of 10 to 18 carbon atoms in the fatty acyl moieties, the paraffin sulfonates, olefin sulfonates and alpha-sulfohigher fatty acid methyl esters. The higher fatty acid soaps may also be incorporated in these products, usually in minor proportions, and mixtures of the various secondary detergents with each other and/or with soaps and with the principal alkylbenzene sulfonate and/or higher fatty alcohol sulfate detergent may be utilized. The various secondary detersive components of the laundry bars will normally be employed as their water soluble salts, and preferably will be sodium salts. Mixtures of different types of salts may be employed, as may be mixtures of the detergents. Normally the higher fatty acyl or alkyl groups of the detergents will be mixtures but essentially pure starting materials may also be employed, so that the detergent, whether a primary or secondary detersive component of the product, may include a lipophilic group, or such groups of essentially the same chain length(s).

Preferred higher fatty alcohol sulfates are those wherein the fatty alcohol is essentially saturated and is of carbon content within the 10 to 18 carbon atoms range, preferably 10 or 12 to 14 or 16 carbon atoms, such as 12 to 16, or that derived from coconut oil (coco), palm oil, or palm kernel oil. Such materials may be obtained from natural sources, such as coconut oil and palm kernel oil, or may be synthesized, as from petroleum products. Sometimes it will be preferred to employ what is characterized as a broad cut of fatty alcohol covering the $C_{10}$–$C_{18}$ range, such as one analyzing about 0.3% of $C_{10}$, 48 to 58% of $C_{12}$, 19 to 24% of $C_{14}$, 9 to 12% of $C_{16}$, and 5 to 13% of $C_{18}$ fatty alcohols. While saturated alcohols are highly preferred as sources for the present detergent, some unsaturated alcohols, normally less than 20% of the total content, may also be present.

Among the secondary detergents the higher fatty alcohol ethoxylate sulfate is preferred. It is preferably of a fatty alcohol which is essentially saturated and of a carbon atom chain length within the 10 to 18 carbon atoms range, often more preferably of 12 to 16 or 12 to 15 carbon atoms. In fact, the various specifications set forth in the previous paragraphs with respect to the higher fatty alcohol sulfate apply too, as applicable, to the higher fatty alcohol of the ethoxylate sulfate. The cation of the ethoxylate sulfate will also be like the cation(s) described previously for the alcohol sulfate but different cations for the alcohol sulfate and the ethoxylate sulfate and mixtures of cations for each may be utilized, too. The ethoxy chain of the ethoxylate sulfate may be of 1 to 20 ethoxy group(s), preferably being 3 to 8 ethoxy group(s), preferably it is of about 3 ethoxy group(s).

The preferred detergent system for use in this invention is a mixture of alkylbenzene sulfonate/higher fatty alcohol sulfate/alkyl polyqlucoside at a mixing weight ratio of from 30–80:0–60:1–45, respectively, preferably 35–80:1–50:3–40, more preferably 40–75:2–30:3–20, for example 77/20/3 40/50/10, 60/0/40, etc.

Various water soluble builder salts, usually as sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other builder salts, of the chelating or precipitating types, inorganic and organic, may also be used, such as sodium carbonate, sodium silicate, normally of $Na_2O$—$SiO_2$ ratio in the range of 1:1.6 to 1:3, preferably 1:2 to 1:3, and more preferably 1:2 to 1:2.4, borax, and sodium bicarbonate. Other builders, including organic builders, such as trisodium nitrilotriacetate (NTA), sodium polyacrylate, sodium citrate and sodium polyacetal carboxylate may be used, as may be other water soluble salts of the corresponding acids.

In addition to the water soluble builders, some water insoluble builders may also be employed, such as detergent building calcium ion exchanging zeolites, including hydrated zeolites A, X and Y, e.g. Zeolite 4A containing about 20% of water of hydration. Such material also may act as bodying agents and can improve processability but while such other desirable properties can be of some importance, herein the zeolites will be considered as builders, and will be included in the proportions specified for builders.

Various mixtures of builders may be employed to make the laundry bars of this invention but it is highly preferable that the primary builder be pentasodium tripolyphosphate (TSPP), preferably hydrated and high in type I crystal form. It has been found that such hydrated polyphosphate, which preferably is hydrated during working in with the other detergent laundry bar components, including water, contributes to improvement of the ease of working, strength and uniform extrusion of the present laundry detergent bars. In addition to functioning as a builder, sodium silicate, when present, can act as a binder for the other components and can help to prevent corrosion of aluminum and other metals by the other detergent bar components. Sodium carbonate has bodying properties too, as does borax.

Water insoluble particulate material components of the present bars, hereafter usually referred to as bodying agents, although they may also perform other functions in the bars, contribute significantly to the formation of a firm, yet processable laundry bar, and help to regulate the release of detergent from the bar during use. While any of many insoluble materials, usually inorganic and mineral, may be employed, such as clays, talc, calcium silicates, magnesium silicate, calcium sulfate, silica, calcium phosphate, and calcium carbonate, the most important of such materials is calcium carbonate, and talc is usually considered to be the next best such bodying agent. Talc, a natural hydrous magnesium silicate, is especially useful for promoting processing ease, improving the feel of the laundry bar, helping to improve its storage characteristics and making a better foam or lather, in conjunction with the other components of the bar. Bentonite, preferably as sodium bentonite, may also be used and has the advantage of functioning as a fabric softening agent for the laundry. It may also be a processing aid.

The calcium carbonate, talc, bentonite and the other insoluble (and often soluble materials, e.g. sodium carbonate, too) will normally be in a finely divided form, often with all or substantially all, e.g. over 99%, passing through a No. 200 sieve (U.S. Sieve Series) and sometimes through a No. 325 sieve. Calcium carbonate, available as Calcite and sodium carbonate, available as soda ash, and other insoluble material may also provide an important function as an abrasive during the use of a laundry bar in hand washing of fabrics.

Instead of the mentioned insoluble bodying agents it has been found that sodium sulfate, which is water soluble, may sometimes be employed, preferably when it is of particle sizes like those given in the preceding paragraph, and often when it is mixed with the insoluble bodying agents.

As disclosed in the assignee's U.S. Pat. No. 4,808,273 laundry detergent bars may also include, to inhibit breakage on handling, a combination of glycerol and higher fatty lower alkanolamide, preferably a higher fatty acid(s) alkanolamide wherein the higher fatty acid(s) is/are of 10 to 18 carbon atoms, preferably of 12 to 14 or 16 carbon atoms, e.g. lauric acid, myristic acid or coco acid, and the lower alcohol is of 1 to 4 carbon atoms, preferably 1 to 3 carbon atoms, more preferably 1 to 2 carbon atoms and most preferably ethanol. The alkanolamides may be monoalkanolamides or dialkanolamides, but the monoalkanolamides are preferred, especially cocomonoethanolamide.

Fatty acids of 10 to 18 carbon atoms, preferably primarily of 12 to 14 carbon atoms, e.g. coco fatty acids, may be used to improve the resiliency of the present bars and to prevent breakage thereof on storage and during shipment, as described in U.S. Pat. No. 4,543,204, but such are not required and sometimes they are preferably avoided.

Various adjuvants may be employed in the present detergent laundry bars for their individual desirable effects. Among such adjuvants are: fatty acids, as mentioned above; binders, such as gums, e.g. carrageenan and alginates, starches and modified starches; plasticizers, such as higher fatty alcohols, e.g. cetyl alcohol, lauryl alcohol; colorants, such as dyes and pigments, e.g. Polar Brilliant Blue dye and ultramarine blue pigment; fluorescent brighteners, such as stilbene brighteners; whitening agents, such as titanium dioxide anti-redeposition agents, e.g. sodium carboxymethylcellulose (which also may have binding properties); enzymes, e.g. protease, amylase; bactericides; fungicides, and solvents.

In addition to the above components water will be present in the laundry bar. While it is preferred to employ deionized water, tap water or city water may be utilized, preferably with the hardness content thereof being no more than 200 parts per million, as calcium carbonate, and more preferably with such hardness being less than 100 or 50 ppm. The water serves as a mutual solvent and plasticizing agent for various components of the detergent bar and facilitates desirable hydration of some of the hydratable materials, such as sodium polyphosphate, sodium pyrophosphate, sodium carbonate, sodium sulfate, bentonite and starch (when present). In conjunction with detergents, binders, bodying agents and/or hydratable salts present, plus some adjuvants, the water tends to facilitate processing, such as milling and plodding, and helps to maintain the detergent bar sufficiently strong so that it will resist cracking and breakage on shipment after manufacture and storage. It appears that any of the higher fatty acid present may inhibit evaporation of moisture from the laundry bar, thereby helping to keep the bar in stronger condition on storage. The alkanolamide and fatty alcohol, if the latter is also present, may also have such an effect.

The proportions of the various components in the final detergents are approximately the same as those in the mixture of materials being formulated (usually in an amalgamator) for milling and plodding because relatively little moisture is lost in such operations. Normally the moisture loss will be between 0.5 to 3%, and most of the time the loss will be between 1 and 2%, e.g. 1.5%. If it appears during the mixing or subsequent operations that the composition is insufficiently plasticized due to low water content, additional water may be employed, which is usually added to the amalgamator, sigma-type mixer or other suitable mixing or blending device, with the various other components of the laundry bar.

The final bar will have a total content of anionic surfactant of from about 10 to 45%, preferably from about 20 to 30%, of which the content of alkylbenzene sulfonate, based on the total bar, will be from about 5 to 35%, preferably 10 to 25%, and the content of higher fatty alcohol sulfate, based on the total bar will be from 0 to 25%, preferably from 0 to about 15%, especially from about 2 to 12%. Secondary anionic detergent co-surfactant, primarily higher fatty alcohol ethoxylated sulfate, when present, will be in amounts up to about 15%, preferably up to about 10%, such as 1%, 2% or 5%, of the total bar.

The alkyl polyglycoside content in the final bar will range from about 1 to 25%, preferably 1 to 20%, more preferably 2 to 15%, and preferably within the ratios, relative to the anionic surfactants, as described above Total builder content will normally be in the range of 10 to 60%, preferably 12 to 40%, and sometimes more preferably 15 to 25%, and it will often be preferred that the builder be inorganic water soluble salt, such as a mixture of sodium tripolyphosphate, sodium carbonate and sometimes, sodium silicate ($Na_2O:SiO_2=1:2.4$) also. The percentage of bodying agent present will normally be in the range of 10 to 65%, preferably 20 to 50% and more preferably 30 to 45%. The ranges of percentages of water in the bar, which includes water removable from any hydrate components when the bar is subjected to heating at 105° C. for two hours, following a normal moisture analysis procedure, will normally be 2 to 15%, preferably 3 to 15%, more preferably 5 to 12%, and sometimes most preferably 6 to 10%, e.g. about 7%. With respect to individual builders and bodying agents it will often be preferred that the builders include 10 to 30% of sodium tripolyphosphate, 5 to 25% of sodium carbonate and 0 to 10% of zeolite, more preferably 10 to 25%, 10 to 20%, and 0 or 2 to 5%, respectively, e.g. about 12 to 20% of sodium tripolyphosphate, about 12 to 20% of sodium carbonate and about 0 to 3% of zeolite. The bodying agent, preferably water insoluble powder, will preferably comprise 10 to 50% of calcium carbonate powder and 0 to 15% of talc, and more preferably 15 to 35% of calcium carbonate, e.g. about 14%, 17%, 22%, 26% or 30%.

The content of alkanolamide, when present, will be in the range of 1 to 10%, preferably 3 to 10%, and more preferably 3 to 7%, e.g. about 5%. The content of glycerol, when present, will be in the range of 0.2 to 5%, preferably 0.2 to 2% and more preferably 0.3 to 1%, e.g. about 0.5%. The ratio of alkanolamide:glycerol may be in the range of 1:5 to 25:1, preferably 1:2 to 20:1 and more preferably, 2:1 to 20:1, e.g. about 10:1.

Adjuvant content will usually be limited to 5% and preferably will be limited to 3%. Thus, the proportion of adjuvants present may be in the range of 0.5 to 3 or 5%, e.g. about 1 or 2%. Moisture content will usually be in the range of 2 to 20%, preferably 3 to 15%, more preferably 5 to 10 or 12%, e.g. about 6 or 7%.

The invented detergent laundry bars can be processed with available equipment of types used for manufacturing soap and detergent bar products. Initially, a heavy duty amalgamator or mixer, such as one equipped with sigma-type blades or one equipped with counter-rotating paddle type agitators, is used to mix the various components, most of which are powdered but some of which may be in liquid or molten state, sometimes as aqueous solutions. The order of addition of the various components of the laundry bars is not considered to be important so long as reasonable care is taken to prevent complete or premature hydration of the phosphate (and any other hydratable components which desirably hydrate during working of the composition) and any excessive lumping which could occur in the mixing process due to such premature and/or uneven hydration. The mixing may take only a short time, but can take from one minute to an hour, with the usual mixing time being from 2 to 15 minutes. The mixed product will desirably be in separable solid form at about room temperature and will be charged, preferably by means of a multiworm transfer conveyor (preferably equipped with cooling means), to multi-rolled mill, such as a five-roll Lehmann mil of the soap mill type. The mill will be equipped with means for heating or cooling and normally the cooling means will be employed to maintain the ribbon temperature from the mill within the range of about 30° to 40° or 45° C. Various ribbon and chip thicknesses may be employed but usually such thicknesses will be in the range of 0.1 to 1 mm., preferably 0.2 to 0.4 or 0.5 mm. However, other thicknesses may be employed, depending on particular formulations being milled, so long as the composition is satisfactorily homogenized on the mill and providing that any coarse particles that may be present are pulverized so that the finished product is not objectionable gritty.

The milled chips or milled material in other form is then conveyed to a double state vacuum plodder, operating under a higher vacuum, e.g. 600 to 740 millimeters of mercury vacuum, in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipping.

The previous description is one for the manufacture of the laundry detergent bars of this invention wherein the anionic detergent(s) is/are added to the mixture in powder, flake, liquid or paste form. However, appropriate detergents, such as the higher fatty alcohol sulfate, may also be made in situ by the neutralization of the appropriate corresponding detergent acid(s) with soda ash or other suitable neutralizing agent. Such a reaction can result in the production of sodium sulfate from any excess sulfuric acid that may be present with the detergent acid, or, if excess soda ash or other sodium base is employed, such as a salt thereof may be in the product. Unreacted higher fatty alcohol or other corresponding lipophile may also be present with the detergent(s). Such materials, the sodium sulfate, sodium carbonate or other builder salt, and the lipophile, may all be useful components of the present laundry bars. The described neutralization reaction may be effected in a separate reactor, but it may also be conducted in the mixer to be employed for mixing the other laundry bar constituents with anionic detergent(s).

However, in an especially preferred embodiment of the invention which is particularly applicable to the invention laundry bars containing the relatively high melting, e.g. about 120° F., especially above about 140° C., higher fatty alcohol sulfates and/or higher fatty alcohol ethoxylated sulfates, the problems associated with mixing the remaining laundry bar ingredients with the molten anionic alcohol sulfate, such as bar softness, can be greatly alleviated.

In the conventional laundry bar forming process the higher fatty alcohol sulfate, for example, coco fatty alcohol sulfate, sodium salt, is solid at room temperature, and forms a thick, but pumpable (flowable) paste at elevated temperatures. In practice, the coco fatty alcohol sulfate is melted at about 150° F. before it is pumped from one area in the bar making plant to the mixer (amalgamator) at a remote location in the plant. However, there is not sufficient time for the thick paste to cool before it is mixed with the remaining ingredients and as a result the product bar is often too soft (mushy).

Therefore, the present invention also provides an improved production process in which the higher fatty alcohol sulfate anionic surfactant is premixed with the alkyl polysaccharide nonionic surfactant without requiring any additional heating. Since the nonionic surfactant is fluid at room temperature the mixture can be readily pumped from the premixing station to the amalgamator at temperatures considerably lower than 150° F., such as about 100° F. or lower. As a result more consistently hard bars can be obtained at lower cost.

Still further, it has been found that when the alkyl moiety of the alkyl polysaccharide is of about the same carbon chain length as the fatty alcohol of the alcohol sulfate and/or ethoxylated alcohol sulfate, a more uniform mixture can be formed and overall improvement in detergency is obtained. Preferably, therefore, in the present invention the alkyl moiety of the polysaccharide and the fatty alcohol of the alcohol sulfate will both contain, on average, the same number of carbon atoms, preferably from 12 to 14 or 16 carbon atoms.

The following examples are given to illustrate the invention but are not to be considered as limiting it. Unless otherwise indicated, all temperatures are given in °C. and all parts and proportions are by weight.

EXAMPLE 1

The formulations shown in Table 1 are prepared as described below. In these examples the alkyl polyglucoside is obtained from Horizon Chemicals as grades APG 600SP ($C_{12}/C_{14}=70/30$ ratio, glycoside unit content=1.5 on average) or APG 625 ($C_{12}/C_{14}/C_{16}=68/26/6$, glycoside unit content=1.5 on average).

TABLE 1

| | | Invention | | |
|---|---|---|---|---|
| | | Run No. | | |
| | Comparison A | B With 5% APG 600SP | C With 5% APG 625 | D With 13.6% APG 625 |
| Dodecyl Benzene Sulfonate, Na | 20.4 | 20.4 | 20.4 | 20.4 |
| Coco Fatty Alcohol Sulfate, Na | 13.6 | 8.6 | 8.6 | 0 |
| Alkyl Poly-glycoside | 0 | 5.0 | 5.0 | 13.6 |
| TSPP | 15.0 | 15.0 | 15.0 | 15.0 |
| Zeolite A | 2.5 | 2.5 | 2.5 | 2.5 |
| Soda Ash | 15.0 | 15.0 | 15.0 | 15.0 |
| Calcite | 26.0 | 26.0 | 26.0 | 26.0 |
| Minors (water, perfume, dye) | 7.5 | 7.5 | 7.5 | 7.5 |

The detergent laundry bars of the formulas given (with 1.5% extra water to compensate for that lost in mixing, milling and plodding) are made by a process which includes the steps of mixing, milling, plodding, cutting to lengths and (optionally) pressing to shape. Mixing is effected in a conventional soap or detergent amalgamator or mixer having a sigma-type mixing blade. The order of addition of the components is not critical but the sodium tripolyphosphate, which is hydratable, is added near the end of the mixing, shortly before the milling or equivalent working. This is done to improve uniformity of hydration of the polyphosphate in homogeneous contact with other bar components, which helps to strengthen the final bar. In the mixing operation described, the various liquid components of the formula are first added to the mixer, followed by the sodium cocoalkyl sulfate (Run A-Comparison) or premixture of the sodium cocoalkyl sulfate and APG 600SP (Run B or APG 625 (Run C), or APG 625 alone (Run D) and any other particulate or powdered components. Mixing takes only a brief time, about 5 minutes, which is intentional so as to inhibit complete hydration of the polyphosphate. The contents of the mixer are fed by multi-worm conveyor to the five-roll mill of the Lehmann type, wherein the mix is converted to ribbon and chip form. The multi-worm transfer conveyor is equipped with cooling means so as to prevent excessive sticking of the mixture to the conveyor parts.

The mill, which is also equipped with cooling means, operates at such a temperature that the final chip is at a suitable temperature, in the range of about 35° to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm of mercury, to remove any entrapped air and to work the composition and extrude it as a bar through a heated nozzle, wherein the composition is heated sufficiently to facilitate extrusion as a homogeneous bar. The bar is then cooled to a suitable pressing temperature, preferably in the range of 20° to 30° C., and is pressed to final bar or cake shape.

Each of the bars of Runs A, B, C and D are evaluated for foaming characteristics (foam height and persistence—foam per bar use-up) and fabric softening (on a scale of 0 to 10 with 10 being maximum softness and 0 being no softening, evaluated by a panel of experts). The results are shown in Table 2.

TABLE 2

| Properties | A | B | C | D |
|---|---|---|---|---|
| Foam Height (mm) | | | | |
| 25 Strokes | 16 | 25 | 20 | 25 |
| 50 Strokes | 28 | 45 | 35 | 50 |
| 100 Strokes | 35 | 80 | 45 | 80 |
| 200 Strokes | 50 | 100 | 80 | 100 |
| Average | 30 | 58 | 42 | 58 |
| Bar % Use-up Average | 13.7 | 10.7 | 8.5 | 6.5 |
| Foam Per Bar Use-up (mm/gms) | 2.3 | 4.7 | 4.3 | 7.8 |
| Fabric Softness Rating (0–10) | 2.7 | 5.1 | 3.3 | 3.0 |

The bars are found to be of satisfactory utilitarian and aesthetic characteristics. Particularly, the bars are found to foam, refoam, and persist in foaming satisfactorily, to feel good to the hands of the user, to soften and clean well, to be sufficiently hard, and not to erode or slough excessively during use (so that they are not consumed too quickly).

EXAMPLE 2

Other compositions within the invention are made, of the same formulas as those of Example 1, except for the employment of an additional 5% of sodium higher fatty alcohol ethoxylate sulfate wherein the higher fatty alcohol is of an average of 12 to 15 carbon atoms and the ethoxylate is of 3 ethylene oxide groups per mole, with the proportion of calcium carbonate being reduced by 5% to compensate for the addition of the anionic co-surfactant. The detergent laundry bars resulting are of improved foaming ability and are more resistant to breakage in handling. Similar results are obtainable when, instead of the sodium coco fatty alcohol sulfate of Example 1, the corresponding triethanolamine or potassium salt is employed as a part of the alcohol sulfate detergent content, e.g. about ¼ thereof. Such results are also obtainable when instead of the sodium coco fatty alcohol sulfate the corresponding detergent derived from tallow alcohol, dodecanol or cetyl alcohol, or a mixture thereof, is employed. Similarly, the anion of the co-surfactant may be lower alkanolamine, potassium or other soluble salt-former, instead of sodium. Other secondary detergents, such as sodium cocomonoglyceride sulfate and sodium paraffin sulfonate, may be substituted for the ethoxylate sulfate detergent. Similarly, the alcohol sulfate may be made from palm alcohol or palm kernel alcohol instead of from coco alcohol, or equivalent natural based materials may be employed, and similar results will be obtained. Similar results will also be obtained when in place of the sodium dodecyl benzene sulfonate used in Example 1 the corresponding lower alkanolamine or potassium salt is used or wherein the alkyl moiety has from 14 to 16 carbon atoms, or, for example, is derived from tallow alcohol, cetyl alcohol, etc.

EXAMPLE 3

When in the preceding examples the proportions of the various components of the invented formulas (excluding the control formulas) are varied, ±10%, ±25%, while being maintained within the ranges recommended in the specification, satisfactory improved detergent laundry bars, having the previously described favorable properties, are also obtainable. Similarly, when other builders, such as sodium NTA, sodium citrate, polyacetal carboxylate, borax and sodium bicarbonate, are employed in partial replacements, e.g. ¼, of the sodium tripolyphosphate and sodium carbonate, individually or taken together, acceptable detergent laundry bars having the desirable properties previously mentioned can be made. Such is also the case when talc is substituted for approximately ¼ of the content of calcium carbonate in the formula and when up to ¼ of the calcium carbonate is replaced by sodium sulfate. Alternatively, bentonite, synthetic calcium silicate, pumice and tricalcium phosphate may be substituted for a part, up to ⅓ of the insoluble bodying agents of the formulas of Example 1. The adjuvants employed may be omitted, and functionally acceptable detergent bars are obtainable, but without the adjuvant's properties, and if desired, other adjuvants may also be present although the proportion thereof should usually not exceed 5% of the total bar.

In the manufacture of the described detergent laundry bars the milling operation may be omitted, with the plodding being utilized to work the composition sufficiently to produce coherent and homogeneous bar products. However, bar quality will not usually be as good as when milling is employed. Similarly, the components of the product may be pressed to bar form without milling or plodding but the product resulting is usually not as strong and may be considered unsatisfactory in physical properties.

The invention has been described with respect to examples and illustrations thereof but it is not to be limited to these because it is evident that one of skill in the art, with the present specification before him, will be able to utilize substitutes and equivalents without departing from the invention.

What is claimed is:

1. A method for manufacturing a laundry bar containing anionic surfactant, detergent builder and detergent bodying agent wherein the anionic surfactant is present in an amount of from about 10 to 45 % by weight based on the final bar and comprises a normally solid higher fatty alcohol sulfate surfactant or a mixture of said normally solid higher fatty alcohol sulfate surfactant and alkylbenzene sulfonate anionic surfactant at a mixing weight ratio of alkylbenzene sulfonate:higher fatty alcohol sulfate of 30–85:1–60, said method comprising premixing the normally solid higher fatty alcohol sulfate with a fluid alkyl polyglucoside nonionic surfactant having from about 12 to 16 carbon atoms in the alkyl moiety at a temperature of no more than 100° F. to form a flowable mixture of the normally solid higher fatty alcohol sulfate and alkyl polyglucoside, and mixing said pre-mixture, detergent builder and detergent bodying agent, plodding the mixture, extruding the plodded mixture and cutting the extruded mixture into the final laundry bar.

* * * * *